United States Patent [19]

Remele et al.

[11] 3,939,625

[45] Feb. 24, 1976

[54] DEVICE FOR PRINTING AND FEEDING COVERS TO CONTAINERS

[75] Inventors: Karl Remele; Dieter Weiberg, both of Schloss Holte-Stukenbrock, Germany

[73] Assignee: Karl Remele, Schloss Holte-Stukenbrock, Germany

[22] Filed: Apr. 21, 1975

[21] Appl. No.: 570,133

[30] Foreign Application Priority Data

Apr. 19, 1974 Germany ..... 2418893

[52] U.S. Cl. ..... 53/131; 53/307; 53/329

[51] Int. Cl.[2] ..... B65B 61/00

[58] Field of Search ..... 53/131, 307, 329; 156/492

[56] References Cited

UNITED STATES PATENTS

| | | | |
|---|---|---|---|
| 3,293,823 | 12/1966 | Anderson | 53/131 |
| 3,712,023 | 1/1973 | Bryan, Jr. et al. | 53/307 |

FOREIGN PATENTS OR APPLICATIONS

| | | | |
|---|---|---|---|
| 871,031 | 6/1961 | United Kingdom | 156/492 |

*Primary Examiner*—Donald R. Schran
*Assistant Examiner*—Leon Gilden
*Attorney, Agent, or Firm*—Sughrue, Rothwell, Mion & Zinn

[57] ABSTRACT

A device for printing and feeding covers to containers, comprises arranged above a conveyor for containers, rotary devices for picking up covers from a supply or stack, and presenting them to a printing device, and for applying the printed covers to the containers with the printed side visible. The rotary devices each comprise a plurality of arms extending from a hub tipped with suction pads. The first device picks up the covers from the supply, acts as an anvil for the printing device, and presents the cover to the second device with the printed side upwardly directed, so that the second device can deposit the covers on the containers, printed side up.

16 Claims, 6 Drawing Figures

DEVICE FOR PRINTING AND FEEDING COVERS TO CONTAINERS

The present invention concerns a device by which covers, more particularly foil covers can be simply and reliably printed on their visible side and applied to containers with the printed visible side upwards.

The device is simple and economical to design and automatically conveys the covers from a feeding mechanism to the containers, said covers being held in such a position that they can be printed on their visible side and secured on the containers with their printed visible side upwards.

The mode of operation of the device is also rational.

An object of the present invention is to make it possible to provide the covers in any desired position on their entire visible surface with a clearly visible sign or mark, said sign or mark and the movement of the cover being effected without damage.

According to the present invention a device for printing and feeding covers to containers is characterised in that, a rotating pick-up is provided, above a conveyor moving the containers, the pick-up being fitted with a plurality of suction heads for removing the covers from a magazine by their sides opposed to their visible sides and keeping them in a predetermined direction of rotation, a printing device printing the covers on their visible side is associated with this pick-up and the pick-up is provided, in the direction of rotation behind the printing device, with a rotating turning over device provided with a plurality of suction heads for engaging the printed covers on their visible side and receiving them from the pick-up, keeping them in a certain direction of rotation and then disposing them on the containers.

The pick-up and turning over device with its suction heads is constructed as a turnstile or revolving star rotating about a horizontal shaft.

The magazine may be provided on one side and the turning device on the other side, of the pick-up, the turning device and magazine being diagonally opposed; the printing device may be arranged between the magazine and the turning device.

It is preferable to convey the covers from the magazine along an S shaped path by the pick-up and the turning device until they are deposited on the containers, and to arrange the area of transfer of the covers from the pick-up to the turning device oppositely to the magazine.

The shaft of the pick-up may be provided with several, preferably four, suction heads telescopically displaceable in a radial direction and the turning device may have a plurality of suction heads preferably six, arranged radially and stationary.

Each suction head of the pick-up and turning device, untwistably connected to the shaft, has a suction channel which extends towards the shaft and is extended in its own channel running in the longitudinal direction of the shaft and connected, with the interposition of a vacuum control device, to a vacuum producer or ventilation means provided for each device.

The telescopically displaceable suction heads of the pick-up are displaced radially outwardly into the magazine extracting position and the cover transfer position by means of a cam plate and control levers co-operating therewith.

The shafts of the pick-up and turning device are connected to a common drive and provided to rotate synchronously; both the cam plate and the printing device which is formed by an inked ribbon and a printing stamp, are driven by the same drive by way of gearwheel and/or contact drive.

The scope of protection of the present invention extends not only to the features of the individual claims but also to the combination thereof.

The device of the present invention makes it possible, in a simple, and reliable manner, to convey and print covers, more particularly foil covers, said covers being automatically removed from a magazine, moved past a printing station and subsequently deposited on containers for sealing said containrs.

The covers are provided on their visible side with a printed sign or the like and deposited on the containers with this printed sign visible upwards. Printing can be carried out in any position on the entire visible surface of the covers and is effected without damage.

In addition, the device moves the thin covers from the magazine to the containers without damage so that they are not adversely affected in their subsequent sealing position.

The printed marking or the like gives a perfectly legible indication on the covers.

The device is simple and economical to construct and operates automatically, the cover being moved by individual parts of the device in a favourable position of its visible side for the printing operation and for depositing on the container.

The device also operates rationally and makes it possible to effect the printing and conveying of the covers economically.

The device is particularly suitable for use with filling and packaging machines in the provisions trade, as also for milk products and can be inserted and arranged as a unit in such a machine.

A preferred embodiment of the present invention is illustrated by way of example in the accompanying drawings in which.

Figure 1:
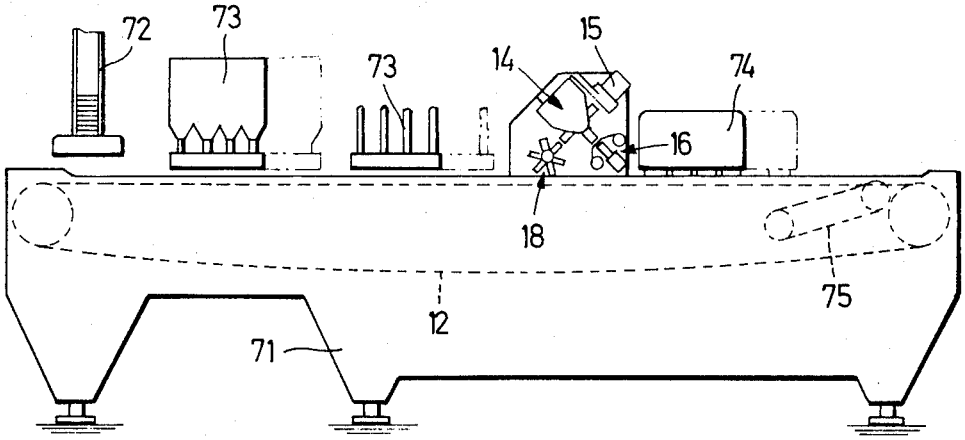
FIG. 1 is a schematic side view of a filling and packing machine comprising a device for the printing and feeding of covers to containers according to the invention.

A device, according to the present invention, for the printing and feeding of covers 10, such as foil covers, (thin cover discs) on containers 11, such as beakers, cups or the like, said device being arraged on a filling and packing maching, for example for the provisions trade, is provided at the top with a conveyor 12, such as an endless rotating belt, chain or the like, for moving the containers 11, a rotating pick-up provided with a plurality of suction heads 13 and removing by its suction heads 13, the covers 10 by the side opposed to their visible side from a magazine 15, and retaining the covers 10 through a predetermined zone of rotation.

This pick-up 14 is associated with a printing device 16 printing the covers 10 on their visible side and providing the visible side of the covers with a mark or the like.

A rotating turning-over device 18, comprising several suction heads 17, is also associated with the pick-up 14 behind the printing mechanism 16 in the direction of rotation. This device 18 together with its suction heads 17 engages the visible side of the printed covers 10, receiving them from the pick-up 14, retains them through a predetermined angle of rotation and then deposits them on the containers 11.

Each cover 10 is preferably moved over an S-shaped path from the magazine 15 to the containers 11, the covers 10 being turned over due to the S-formation of this path, said covers being provided on their visible side with printed matter and deposited on the containers 11 with their visible side lying upwardly (outwardly). The turning device 18 and magazine 15 are disposed oppositely to each other on two sides of the pick-up 14, the magazine 15 being arranged above the pick-up 14 and the turning device 18 below it both members 15 and 18 are preferably located diagonally oppositely to each other. The printing device 16 extends between the two members 15 and 18 and is provided in a lower side portion of the pick-up 14.

The pick-up 14 and the turning device 18 are preferably formed by turnstiles or revolving stars and each device, 14, 18 is rotatable about a horizontal axis (shaft) 19, 20; both shafts 19, 20 are parallel to each other and extend with their longitudinal direction transversely (at right angles) to the direction of movement of the receiving containers. The pick-up 14 is provided on a bearing body 21 mounted rigidly on the shaft 19, with several, for example, four radially outwardly extending and telescopic suction heads 13, each of which picks up a cover 10 in succession from the magazine 15, moves it past the printing device 16 for printing and after an angle of displacement of approximately 180° (a half rotation of the shaft 19) returns it to the turning device 18. Each suction head 13 comprises a base part **13*a* secured to the bearing body 21, and a cup or tub-shaped member 13*b*** secured displaceably thereto in a radial direction.

Figure 2:
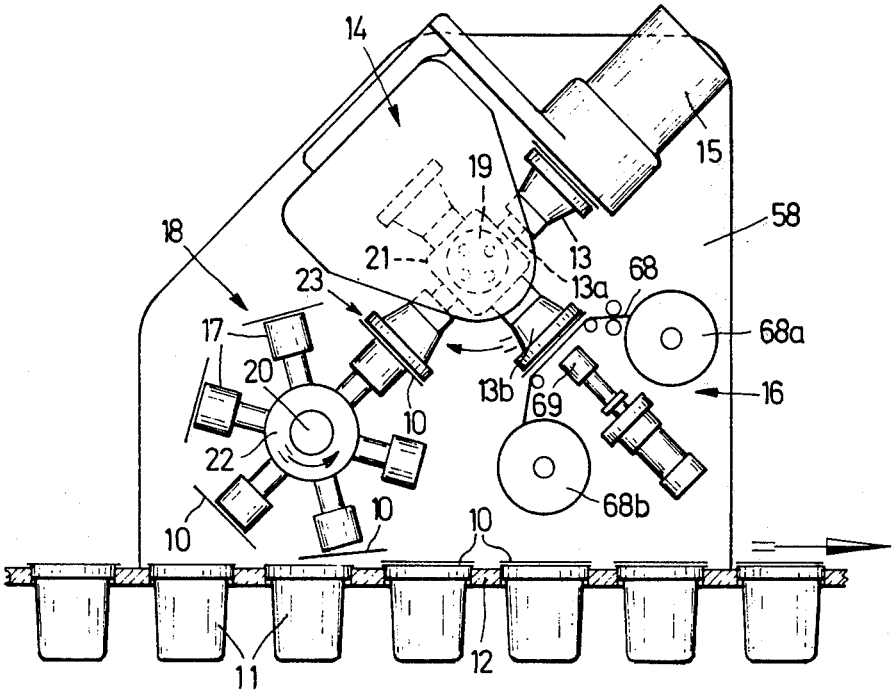
FIG. 2 is a side view of the printing and feeding device incorporating a cover magazine, a pick-up, a printing device and turning device.

The turning device 18 is provided on a bearing body 22, rigidly mounted on the shaft 20, with several, for example, six suction heads 17 which are arranged radially around the shaft 20 and are themselves rigid (not telescopically displaceable). In the transfer area indicated by the reference numeral 23 in FIGS. 2 and 3, these suction heads 17 receive respective covers 10 from a suction head 13 of the pick-up 14, engage the cover 10 on its printed visible side and move it in an angle of more than 180° (more than a half rotation of the shaft) to the containers 11 suspended from the conveyor 12. The direction of rotation of the two device 14 and 18 is opposite to each other, so that the S-shaped path of the covers 10 is produced — the directions of rotation are indicated by arrows in FIG. 2 and 3.

However, it is possible to allow both devices 14, 18 to operate with the same direction of rotation, the turning device 18 guiding the cover downwardly to the containers 11 over a path of less than 180° after the transfer of the cover 10 in the area 23; in this case each cover 10 would be guided over a W-shaped path.

All the suction heads 13, 17 are subjected to a vacuum during the movement of the covers 10 and retain said covers 10 by this vacuum.

All the suction heads 13 of the pick-up 14 and all the suction heads 17 of the turning device are connected during the movement of their covers to vacuum producers 24, 25 which are connected through respective lines 26, 27 to vacuum control devices 28, 29 each of which is coupled to the shafts 19, 20.

Both vacuum control devices 28, 29 are identically constructed and operate identically.

Extending from each suction head 13, 17 as far as the shafts 19, 20 are suction channels 30 and 31 which are connected to their own feed channels 32 and 33 extending in the longitudinal direction of the shafts 19, 20.

The vacuum control device 28, 29 is provided with a stationary part 34, 35 and a rotating part 36, 37 rigidly connected to the shaft 19, 20. The line 26, 27 is connected to the stationary part 34, 35 and communicates with a groove 38, 39 extending in a divided (or pitch) circle around the shaft 19, 20 in the stationary part 34, 35 — this groove 38 is located at one end near the magazine 15 and at its other end with a clearance from the transfer area, so that it assumes an angle of less than 180° in the part 34. The groove 39 begins with one end in the transfer area 23 and it other end is located near the position where the cover 10 is to be handed over again — this groove 39 assumes an angle of more than 180° in the part 35.

A ventilation channel 40, 41 is provided with a clearance from the particular level end of the groove 38, 39 (viewed in the direction of rotation), in the stationary part 34, 35. Each channel 32, 33 of the shaft 19, 20 communicates with an angled channel 42, 43 in the part 36, 37, connected to the shaft 19, 20, and this angled channel 42, 43 represents a vacuum connection with the groove 38, 39 and with the ventilation channel 40, 41. The channels 32, 30 and 33, 31 are subjected to vacuum over the path along which the channel 42, 43 extends in the region of the groove 38, 39 and when the channel 42, 43 extends into the area of the ventilation bore 40, 41, the vacuum is cancelled.

The pick-up 14 and the turning device 18 are each preferably provided with two adjacently spaced and simultaneously operating suction heads 13, 17, so that two covers 10 can always be simultaneously conveyed, printed, turned and deposited.

Hence four pairs of suction heads 13 are arranged in cross formation on the pick-up 14, and six pairs of suction heads 17 are arranged in star shaped formation on the turning device 18.

Both adjacent suction heads 13 communicate through a transverse channel 44 with both their suction passages 30 and a conduit 45 extends from this transverse channel 44 to the channel 32 in the shaft 19.

The channels 33 are extended as channel **33*a* in the shaft 20 by means of the two adjacent heads 17 and, from the extended channel 33*a* the suction channel 31 extends to the head 17. It is within the scope of this invention to provide each device 14, 18 with three or more adjacent suction heads 13, 17, so that more than two covers 10** can be moved simulataneously.

A control disc 46 is arranged around the shaft 19 with a clearance from the suction head 13. The disc 46 comprises a cam plate 47 which is used for pushing apart and together the suction heads 13 disposed oppositely to each other and located near the magazine 15 and the transfer area 23, so that one suction head 13 can be moved into the magazine 15 for picking up a cover 10 and the other suction head 13 radially outwardly for transferring a cover 10 to a suction head 17 of the turning device 18.

The control path 47 is composed of two relatively oppositely disposed parts 47*a* extending in a divided circle with the same clearance around the shaft 19. The track components 47*a* retain the suction heads 13 in the retracted position and hold together two components 47*b* which project in an arc outwardly over the parts 47*a*, extend with the same clearance from the shaft 19 but with a greater clearance from the shaft 19 than the components 47*a*. The track components 47*b* effect the outward radial movement of the heads 13.

A control lever 48 is provided at one end to pivot about a shaft 49 extending parallel to the shaft 19 on both sides of said shaft 19 and at it other end engages in the cam plate 47 by a guide member 50, preferably a roller.

Two actuating levers 51, provided with a clearance from each other and rigidly connected to the shaft 49 are mounted at one end on said shaft 49 and at their other end carry an actuating member 52, preferably a roller, which co-operates with an arcuate guide path 53 of each suction head 13 from time to time.

When the suction head 13 or the two suction heads 13 forming a pair come into the area of the magazine 15, the roller 52 of the actuating lever 51 associated with each suction head 13 engages in the guide track 53 of the suction head and radially pushes out and then pushes in the suction head 13 during the pivoting of the lever, dependently on the control lever 48. When the suction head 13 or the two suction heads 13 forming a pair comes in to the transfer area 23, the lever 51 associated with each of the two suction heads 13 again engages by its roller 52 in the guide track 53 of the suction heads and displaces said suction heads 13 radially outwardly and then again radially inwardly. Both control levers 48 are rigidly connected to the shaft 49 and they receive their total movement from the cam plate 47. Since the levers 51 are also rigidly connected to the shaft 49 they have to execute a pivotal movement even if the lever 48 makes a pivotal movement.

Each of the two control levers 48 simultaneously operates two actuating levers 51 which then radially displace a pair of suction heads 13. Due to the cam plate 47, both control levers 48 alway pivot in opposite directions, i.e., either both outwardly, or both inwardly. The two opposed portions of track 47*b* effect the pivoting of the levers 48 away from each other and towards each other again and the movement of the suction heads 13 outwardly and inwardly, and the two opposed portions of track 47*a* effect the stopping of the control levers 48 after the pushing in of the suction head 13 during the pivoting process.

Another guide track 54 is also provided around the shaft 19. It is stationary and retains the suction heads 13 in the retracted position during the movement between the magazine and the transfer area 23 and transfer 23 and magazine 15.

For this purpose the guide track 54 is provided at two opposed points in the region of the magazine 15 and transfer area 23 with respective insertion slots 55 through which each retracted suction head 13 is moved into the path 54 by a retaining member 56, preferably a roller, this roller 56 is supported against the inner surface of the circular guide track 54 and extends again out of the other slot 55. This guide track 54 is connected to a bearing of a housing wall 58 or to a supporting yoke 58*a* mounted on the housing wall 58, rotatably receiving the shaft 19; the housing wall 58 and supporting yoke 58*a* receive the two shafts 49 for rotation.

The drive for the shafts 19, 20 and the control disc 46 is provided between two walls 58 of a gear casing and on one side of the casing 58 the vacuum producers 24, 25 extend out of said casing and, on the other side of the casing 58, are disposed the suction heads 13, 17. A drive shaft 60, continuously rotated by a drive 59, rigidly supports a driver disc 61 which is provided on one side with at least two drivers 62 displaced through 180° relatively to each other in the direction of rotation and co-operating as a stepping drive with a Maltese cross 63 which is rigidly secured to the shaft 19, and drives the shaft 19 synchronously, preferably with an operative time/inoperative time of 1 : 1.

The shaft 60 is provided with a gearwheel 64 meshing with a gearwheel 65, which is mounted to rotate on the shaft 19 and is not in driving engagement with said shaft 19 on which the cam plate 46 is secured, and is driven by the gearwheel 65 for actuating the control lever.

A gearwheel 66 is rigidly mounted on the shaft 19 and meshes, for driving the turning device 18, with a gearwheel 67 provided on the shaft 20. Both spur gears 66, 67 produce a transmission ratio in the drive from the shaft 19 to the shaft 20, for example a ratio of 4–6. The shaft 19 also provides the drive for the printing mechanism 16 formed for example by an inked ribbon 68 and a printing stamp. The ribbon 68 unwinds from a roller 68*a* and winds onto a second roller 68*b* again. At the same time, one of the two rollers 68*a* or 68*b* is driven from the shaft 19 to the ribbon feed by way of a contact and/or gearwheel drive 70.

The receiving, conveying, printing and depositing of the covers 10 is effected as follows:

The shaft 19 receives its rotation through the drive 59, 60, 61, 62, 63 and the shaft 20 receives its rotation from said shaft 19 through the drive 66, 67. At the same time, the control disc 46 is rotated by the shaft 60 by way of the drive 64, 65, the two levers 48 receiving through the disc 46 their pivoting control movement which they transmit to both the levers 51 in driving engagement with the levers 48 by way of the shafts 49.

The covers 10 are stored one above the other in layers in the magazine 15, with their visible side facing upwardly.

Figure 3:
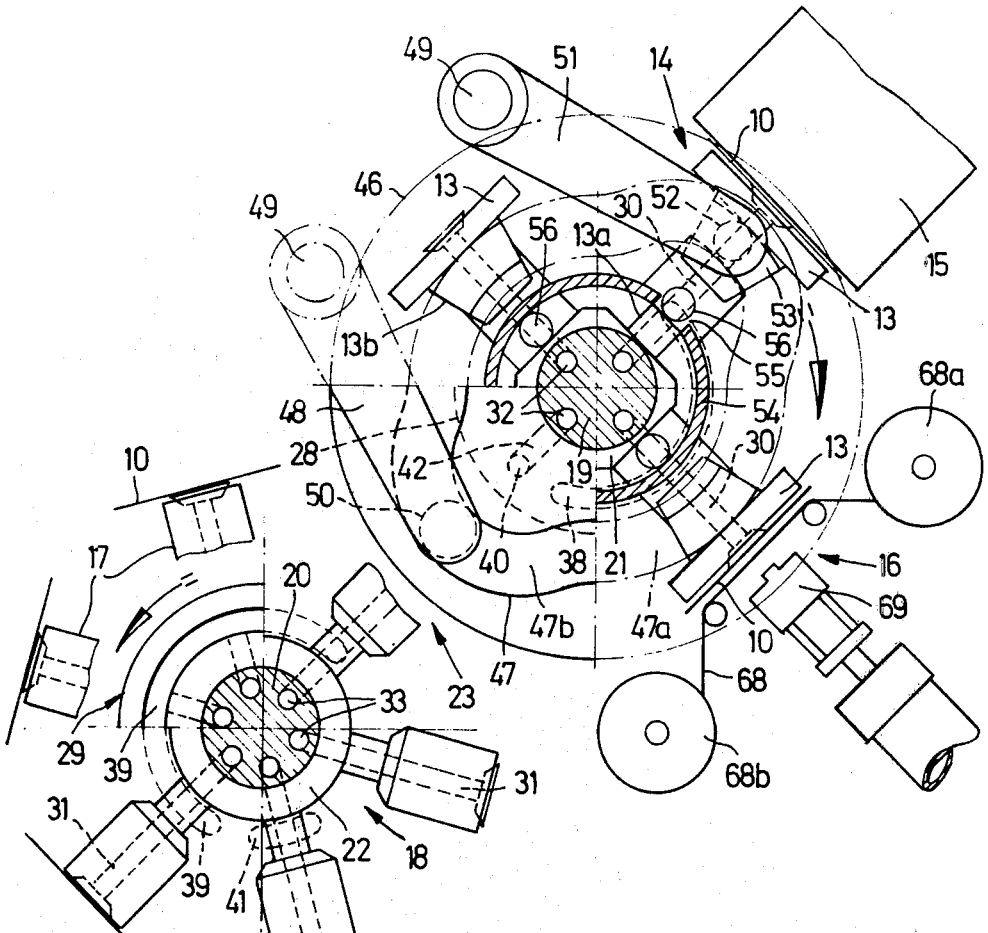
FIG. 3 is a side view, partly in cross-section of the printing and feeding device.
Figure 6:
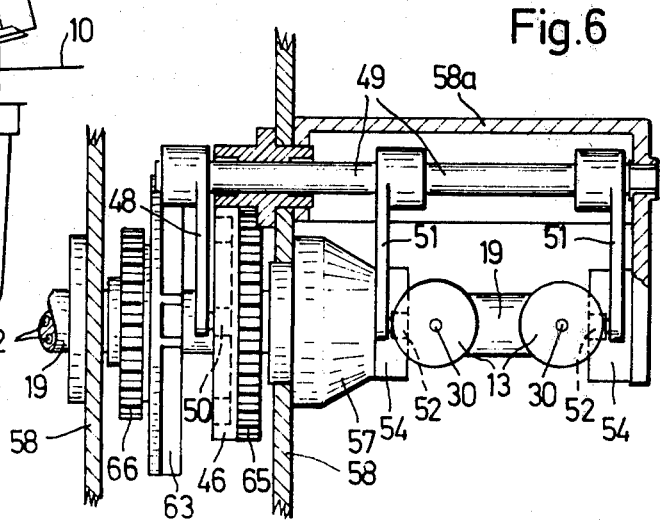
FIG. 6 is a front view in partial cross-section to two suction heads of the printing and feeding device, as also of the driving and control means.
Figure 4:
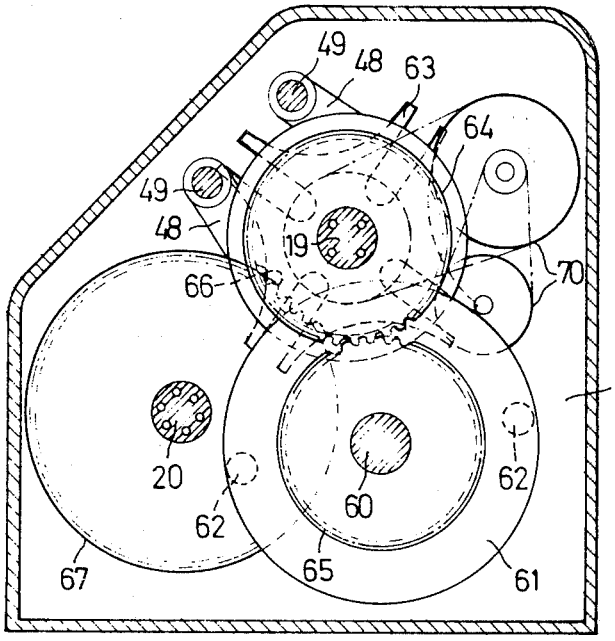
FIG. 4 is a side view, in partial cross-section of the drive of the printing and feeding device.
Figure 5:
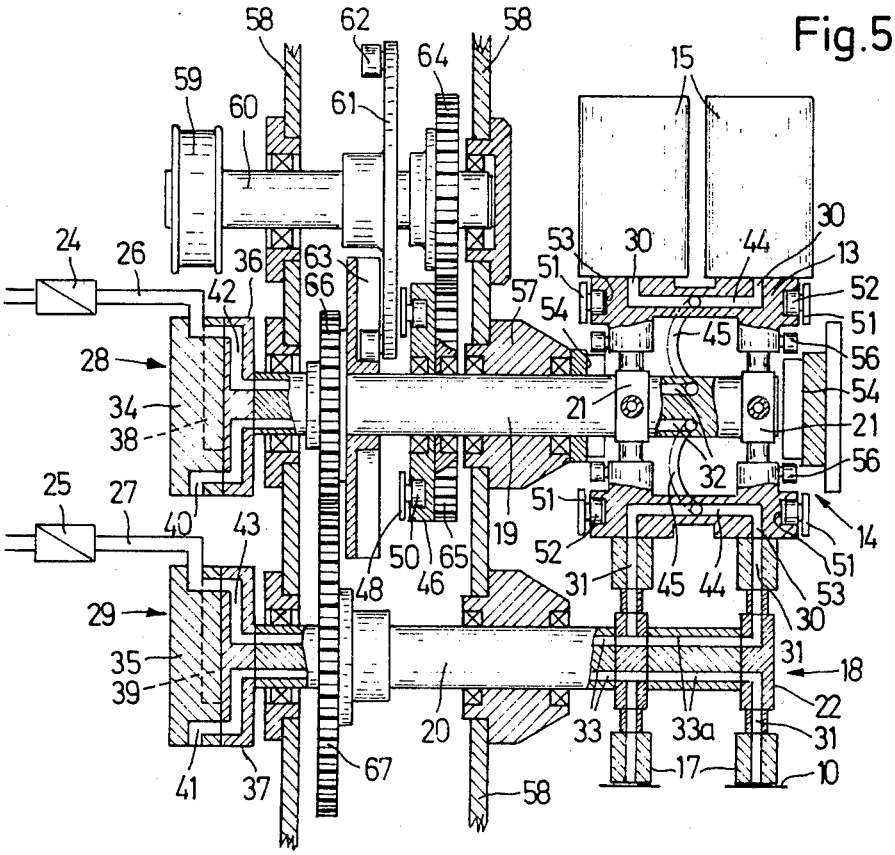
FIG. 5 is a front view of the printing and feeding device in cross-section and shown partially displaced relatively to the parts of the apparatus.

In FIGS. 3 and 5 of the drawings, the levers 51, 48 are shown in the position for receiving and transferring the covers. The suction head 13 extended during its inoperative period by the lever 51 communicates in this receiving position, through its channel 30, the channel 32 and the channel 42, with the groove 38 and is thus subjected to vacuum. The suction head 13 then picks up a cover 10 by its from for the magazine 15. The suction head 14 is returned to its starting position by the continuous rotating cam plate 47, i.e. out of the portion of track 47*b* moving the suction head 13 outwardly and into the portion 47*a* drawing it inwardly and thereby extracts a cover 10 from the magazine 15. At the same time, the suction head 13 with its roller 56 passes through the slot 55 into the guide track 54 and is kept in contact therewith on its inner side by its roller 56. As it is rotated in the direction of the arrow (FIG. 3.) the vacuum connection 30, 32, 42 of the suction head is now in continuous communication with the groove 38 so that the vacuum holding the cover 10 on the suction head 13 is maintained.

The cover 10 is then moved towards the printing station 16 and, in the resultant resting period determined by the Maltese cross 63, is printed by the inked ribbon 68 and the printing stamp 69, this printing operation being effected on the visible side of the cover 10.

During the next resting period the suction head 13 has reached the transfer area 23; at the same time the suction head 13 is moved outwardly again by the lever 48 which has moved into the area 47*b* of the cam plate and, with its roller 56, out of the slot 55 in the guide track 54.

The groove 38 ends in this position and the bore 42 remains subjected to vacuum as it continues to move to the v-ventilation bore 40. However, when the bore 42 reaches the ventilation bore 40, the vacuum connection 42, 32, 30 of the suction head 13 is ventilated. In this position a suction head 13 of the turning device 18 is disposed just opposite the ventilated suction head 13 and receives the cover 10 from the said suction head 13. The suction head 17 receiving the cover 10 is disposed with its channel 31, 33 and 43 in the region of the groove 39 and is thus subjected to vacuum, so that the cover 10 is held by suction against the suction head 17.

This suction head 17 grips the cover 10 on its visible side provided with printed matter and moves it in the direction of the arrow (FIG. 3) in a divided or pitch circle downwardly to the conveyor belt 13. In the final operating period the groove 39 terminates before the delivery of the cover 10 to a container 11 and the suction head 17 moves shortly thereafter with its channel 43, 33, 31 into the ventilating bore 41 and is ventilated.

This cancels the vacuum and the cover 10 drops from the suction head 17 onto a container 11. The inoperative position of the suction head 17 in the delivery position must have a certain lead "X", so that, in the vertical position of the suction head 17, synchronism with the continuously driven conveyor belt 12 is ensured during the transfer of the cover 10 (FIG. 3). This lead is unnecessary if the conveyor belt 12 is driven intermittently.

Each suction head 13 is moved outwardly in the region of the magazine 15 for receiving a cover 10 from the magazine 15 and in the opposite transfer area 23 for depositing the printed cover 10 on the suction head 17 of the turning device 18, by the co-operating pair of levers or the three levers 48, 51 disposed on a shaft 49 and held within the guide circle 54 and between these two outwardly moved positions.

The pick-up 14 and the turning device 18 operate synchronously and dependently on each other, for example, the pick-up 14 executes four strokes with one rotation and the turning device 18 six strokes with one rotation. However, this is dependent on the number of suction heads 13, 17 in both devices 14, 18, the ratio of which determines the strokes.

The device of the present invention may be used more particularly for the feeding and printing of covers 10 which are provided with a filling date or a date by which the contents must be consumed, the price or the like. In addition, the covers 10 are provded for the closing of beakers, (tubs) cups or the like which receive a milk product such as yoghurt, cream cheese or the like. However, covers 10 may also be printed and applied to containers 11 which receive any other type of filling.

As shown in FIG. 1, this device is arranged on a filling and packing machine which is provided in a machine bed 71 with the conveyor belt 12 and, arranged in succession in the direction of movement of the belt, for example, with a container feed mechanism 72, one or more filling devices 73, such as a fruit and milk feeding system, then the device of the present invention and, finally, a cover welding device 74. An expelling device 75, such as an upwardly inclined expelling belt, is provided behind the cover welding device 74 in the area of the conveyor belt 12, said expelling belt forcing the filled and sealed containers upwardly out of the holders of the conveyor belt 12.

What we claim is:

1. A device for printing and feeding covers to containers, characterised in that a rotating pick-up is provided above a conveyor for moving the containers and provided with a plurality of suction heads for taking the covers from a magazine by their side opposed to the visible side, and keeping them on a certain path of rotation, a printing mechanism printing the covers on their visible side, being associated with this pick-up, and a rotating turning device, provided with several suction heads for engaging the printed covers by their visible side and receiving them from the pick-up, keeping them in a certain path of rotation and then depositing them on the containers, is provided for the pick-up in the direction of rotation behind the printing mechanism.

2. Device according to claim 1, characterised in that the pick-up and the turning device with their suction heads form in each case a turnstile or a revolving star rotating about a horizontal shaft and, at the same time, the pick-up is provided on its shaft with several, preferably four suction heads telescopically displaceable in a radial direction, and the turning device comprises on its shaft several, preferably six, radially disposed and stationary suction heads.

3. Device according to claim 2, characterised in that the magazine is arranged on one side and the turning device on the other side of the pick-up and the turning device and the magazine are diagonally opposed to each other and the printing mechanism is arranged between the magazine and turning device.

4. Device according to claim 3, characterised in that the covers are transportable from the magazine until they are disposed on the containers by the pick-up and the turning device over an S-shaped path and the area of transfer of the covers from the pick-up to the turning device is provided opposite to the magazine.

5. Device according to claim 4, characterised in that each suction head of the pick-up and the turning device rigidly connected to the shaft has a suction channel leading towards the shaft and continuing in its own channel extending in the longitudinal direction of the shaft, said channel communicating, with the interposition of a vacuum control device with a vacuum producer provided for each device.

6. Device according to claim 5, characterised in that the pick-up and the turning device are each associated with a vacuum control device through a pipeline to the vacuum producer said control device having a stationary part and a rotatable part rigidly connected to the shaft, a vacuum groove connected to the pipeline and a ventilating terminal provided with a clearance therefrom being arranged in the stationary part, and a channel running in the extension of each shaft channel and alternately connectable with the vacuum groove and with the ventilation channel are provided in the rotatable part.

7. Device according to claim 6, characterised in that the vacuum groove extends curved in the form of a divided circle in the stationary part of the two vacuum control devices and assumes an angle of approximately 180° and is provided in the direction of rotation of the suction heads with a clearance behind the vacuum groove of the ventilation channel emerging from the stationary part.

8. Device according to claim 7, characterised in that the telescopically displaceable suction heads of the pick-up are radially outwardly displaceable into the magazine extraction position and the cover transfer position by means of a control disc and control levers co-operating therewith.

9. Device according to claim 8, characterised in that the control disc is provided to rotate about the shaft of the pick-up and has a cam track which is formed by a groove and, near the magazine and the transfer area has portions extending outwardly in an arc in opposite directions, said portions which merge with each other into two portions opposed to each other and extending with the same clearance from the shaft, but with a smaller clearance from said shaft than the portion.

10. Device according to claim 9, characterised in that on each side of the shaft a control lever, rigidly connected to a pivot axis, is provided which engages by a control member, preferably a roller, in the cam track and an actuating lever also untwistably connected to the pivot axis is mounted with a clearance from the control lever, said actuating lever having an actuating member, preferably a roller, for the telescopic displacement of the suction heads, engaging in a cam track of each suction head.

11. Device according to claim 10, characterised in that a stationary, circular guide track is provided around the shaft of the pick-up and has, near the magazine and in the transfer area, a slot through which, during the radial displacement of the suction head in the direction of the shaft, a retaining member, preferably a roller, is moved positively guiding the suction head in its pushed-in position along the guide path.

12. Device according to claim 11, characterised in that the two shafts are connected to and synchronously rotated by a common drive and at the same time both shafts are rotatably mounted in a gear casing and on one side of the casing, outside thereof, the suction heads are provided and, on the other side of the casing outside thereof the vacuum control devices are provided.

13. Device according to claim 12, characterised in that the gear casing contains a rotatable drive shaft connected to the drive and provided with a plate-shaped disc having at least two drivers, said disc co-operating with its drivers with a Maltese cross for the shaft drive, mounted on the shaft of the pick-up that a gearwheel is non-rotatably mounted on the shaft and, for driving the shaft of the turning device, meshes with a gearwheel mounted on the shaft, and that the control disc is mounted on a gearwheel which is rotatable about the shaft of the pick-up and meshes with a gearwheel untwistably secured to the drive shaft.

14. Device according to claim 13, characterised in that the printing mechanism is formed by an inked ribbon winding and unwinding on two rollers and by a printing stamp co-operating with the inked ribbon and at the same time an inked ribbon roller is coupled through a gearwheel and/or contact drive with the shaft of the pick-up or the drive shaft.

15. Device according to claim 14, characterised in that two or more suction heads are provided adjacently to each other on the shafts and the suction channels of which communicate through connecting lines with the associated shaft channels, an actuating lever being associated with each of the suction heads arranged adjacently to each other in pairs and the actuating levers are secured to the common shaft rotated backward and forwards by the control lever.

16. Device according to claim 15, characterised in that said device is arranged on a filling and packing machine which is provided, above a conveyor belt as conveying means, in the direction of travel, and in succession, with a container feed device, with one or more filling devices, the printing and feeding mechanism, a cover welding device and, near the conveyor belt, behind the cover welding device, has a device, such as an inclined conveyor belt, expelling the filled and sealed containers from the conveyor belt.

* * * * *